US005657493A

United States Patent [19]

Ferrero et al.

[11] Patent Number: 5,657,493

[45] Date of Patent: Aug. 19, 1997

[54] DIVING MASK WITH QUICK-RELEASE STRAP ATTACHMENT

[75] Inventors: James Ferrero, Chicago; James R. Lutz, Elk Grove, both of Ill.

[73] Assignee: Dacor Corporation, Northfield, Ill.

[21] Appl. No.: 589,445

[22] Filed: Jan. 22, 1996

Related U.S. Application Data

[63] Continuation of Ser. No. 255,658, Jun. 8, 1994, abandoned, which is a continuation-in-part of Ser. No. 20,424, Mar. 25, 1994, Pat. No. Des. 371,566.

[51] Int. Cl.[6] ..... B63C 11/12

[52] U.S. Cl. ..... 2/428; 2/452; 24/625

[58] Field of Search ..... 2/428, 430, 452, 2/426; 24/625, 323, 324, 265 BC, 615, 616

[56] References Cited

U.S. PATENT DOCUMENTS

| | | | |
|---|---|---|---|
| D. 290,763 | 7/1987 | Walsh | D29/9 |
| D. 302,747 | 8/1989 | Hattori | D29/9 |
| 4,150,464 | 4/1979 | Tracy | 24/77 |
| 4,264,987 | 5/1981 | Runckel | 2/428 |
| 4,607,398 | 8/1986 | Faulconer | 2/452 |
| 4,688,337 | 8/1987 | Dillner et al. | 24/616 |
| 4,795,385 | 1/1989 | Matsuoka | 441/64 |
| 5,020,193 | 6/1991 | Kunze | 24/323 |
| 5,181,280 | 1/1993 | Zachry, Jr. | 2/452 |
| 5,379,496 | 1/1995 | Krauss | 24/625 |
| 5,390,373 | 2/1995 | Flory | 2/430 |
| 5,564,132 | 10/1996 | Kuo | 2/430 |

FOREIGN PATENT DOCUMENTS 79699 2/1995 Japan .

*Primary Examiner*—Peter Nerbun

*Attorney, Agent, or Firm*—Greer, Burns & Crain, Ltd.

[57] ABSTRACT

A diving mask includes a frame with a front portion and first and second side portions and enclosing at least one lens, a flexible skirt secured to the frame and constructed and arranged to provide a water-tight seal between the frame and the user's face, at least one of the side portions having one of a first and second coupling portions of a quick-release buckle assembly, and a mask strap having first and second ends, at least one of which being engaged with the other of the first and second coupling portions for effecting a releasably lockable coupling of the strap to the frame. A major feature of the present invention is that the mask strap is adjustable in length independently of its attachment to the mask frame, while being readily detachable from the mask frame.

17 Claims, 4 Drawing Sheets

DIVING MASK WITH QUICK-RELEASE STRAP ATTACHMENT

RELATED APPLICATION

This is a continuation of application Ser. No. 08/255,658, filed on Jun. 8, 1994, now abandoned, which is a continuation-in-part of U.S. patent application Ser. No. 29/020,424, filed Mar. 25, 1994, now U.S. Patent No. Des. 371,566, issued Jul. 9, 1996, and entitled, "DIVING MASK".

BACKGROUND OF THE INVENTION

The present invention relates to diving masks used for snorkeling, skin diving and scuba diving, and specifically to a diving mask wherein the mask strap is quickly releasable from the mask frame.

Conventional diving masks are attached to the diver's head with an elastic mask strap. Each end of the mask strap is threaded into a latch located on a corresponding side of the mask frame. Various mechanical latch devices are employed to retain the strap in place, while providing for manual adjustment of the strap length.

One conventional mask strap latch system includes a mask strap having a series of spaced, generally vertical ribs on one face. The strap is fed around at least one generally vertical post in a latch frame in a serpentine manner. A biased keeper member engages one of the ribs on the strap to prevent the strap from loosening. A tab member integral with the keeper allows the diver or user to overcome with one hand the biasing force or pressure exerted by the keeper, while the strap is pulled with the other hand to loosen the strap adjustment. The same procedure is used to entirely remove the strap from a selected side of the mask frame to install the mask strap retainer of a conventional snorkel.

A major disadvantage of such mask strap attachment arrangements is that the required two-handed procedure for making adjustments to the strap length is often difficult to perform under wet conditions.

Another disadvantage of conventional mask strap attachments is that the diver's hair often becomes caught or tangled in the mask strap, and becomes difficult to untangle without unlatching at least one end of the mask strap from the corresponding side of the mask frame.

Still another disadvantage of conventional mask strap attachments is that when used with a breathing snorkel having a loop-like mask strap retainer, the mask strap must be detached from the latch to thread through the snorkel mask strap retainer. This is a tedious and often frustrating operation, especially when attempted with wet hands.

A related disadvantage is that when the dive is completed, and the diver stores his equipment, the mask must again be disconnected from the snorkel where the loop-type of mask trap retainer is employed, requiring another unthreading of the mask strap from the snorkel attachment, as well as from the mask frame latch. This repeated unthreading and rethreading of the mask strap into and out of the mask frame also makes mask adjustment more difficult, in that the mask strap must be readjusted for each use, and the strap adjustment must be fine tuned while in the water. A strap which is too loose may allow the leakage of water into the mask, impairing vision and diver comfort. On the other hand, a mask strap which is too tight may be uncomfortable, and may also interfere with the diver's clearing of his ears to equalize the pressure on either side of the ear drums, and gradually adjust them to greater depths.

Thus, it is a principal object of the present invention to provide a diving mask with a mask strap which is detachable from the mask frame independently from the mask strap length adjustment.

It is another object of the present invention to provide a diving mask with a mask strap which is easy to adjust under wet conditions.

It is still another object of the present invention to provide a diving mask with a mask strap coupling mechanism which permits rapid decoupling of the mask strap from the mask frame.

SUMMARY OF THE INVENTION

Accordingly, the above-listed objects are met or exceeded by the present diving mask, in which at least one end of the strap is secured to one end of a quick-release buckle. In the preferred embodiment, one portion of the buckle is provided with a strap length adjustment latch device, so that adjustment of the length of the mask strap may be accomplished independently from the decoupling of the strap from the mask frame. Thus, mask strap length may be easily changed under wet conditions through the use of a large, grooved tab which easily pulls away from the divers head to release the strap for adjustment. Another advantage of the present mask strap attachment is that snorkels having loop-type mask strap attachments may be quickly installed and detached from the mask strap without interfering with the often carefully adjusted length of the mask strap.

More specifically, the present diving mask includes a frame with a front portion, first and second side portions and encloses at least one lens. A flexible skirt is secured to the frame and is constructed and arranged to provide a water-tight seal between the frame and the user's face. At least one of the side portions has one of a first and second coupling portions of a quick-release buckle. Also included is a mask strap having first and second ends, at least one of which being engaged with the other of the first and second coupling portions for effecting a releasably lockable coupling of the strap to the frame. A major feature of the present invention is that the mask strap is adjustable in length independently of its attachment to the mask frame. Another feature of the present invention is that the mask strap adjustment portion, the prong or male portion of the quick-release buckle, and the tab-type strap release device are provided as a unitary piece which may be molded of suitable plastic material.

DETAILED DESCRIPTION OF THE PREFERRED EMBODIMENT

Figure 1:
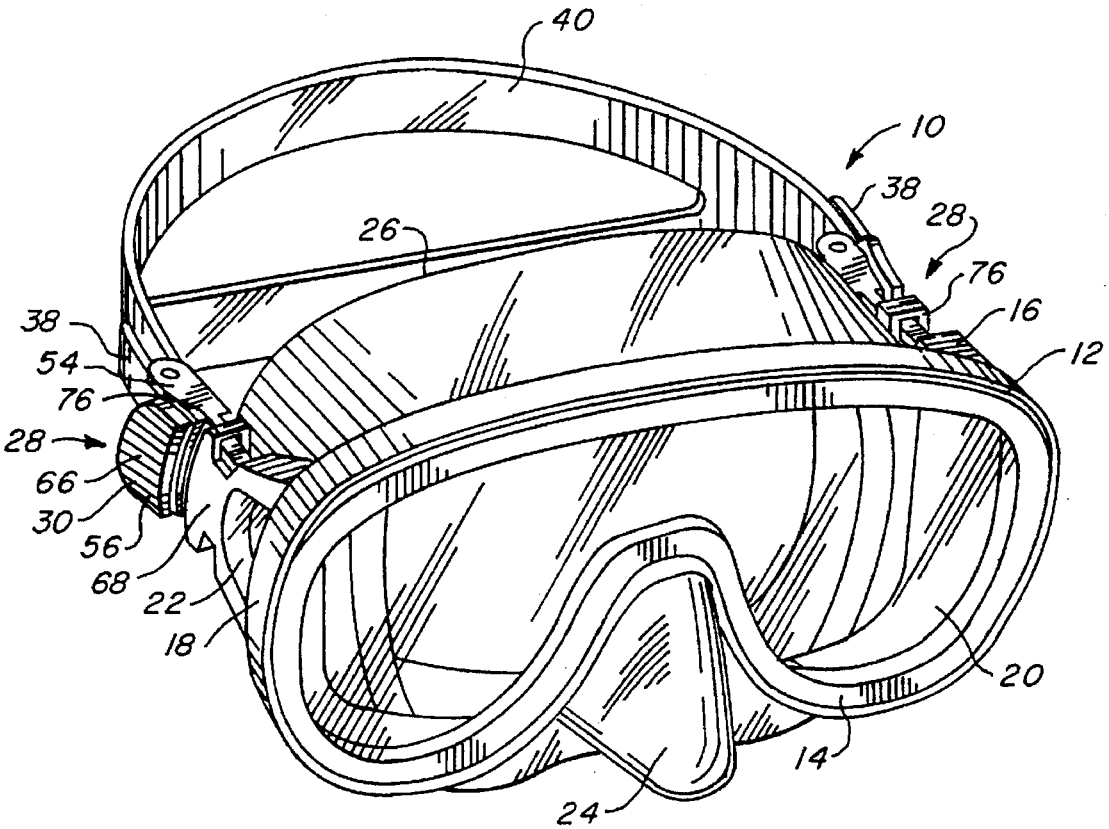
FIG. 1 is a front perspective elevational view of the present mask.

Referring now to FIGS. 1–4, the present diving mask is generally designated 10, and includes a frame 12 including a front portion 14 and first and second side portions 16, 18, respectively. At least the front portion 14 encloses a lens 20, and it is contemplated that at least one of the first and second side portions 16, 18 may also each enclose a relatively smaller lens 22 to enhance the peripheral underwater vision of the diver. In the preferred embodiment, the side portions 16, 18 of the frame 12 sweep rearward at an approximate right angle to the longitudinal axis of the frame to form a general U-shape when viewed from above or below (best seen in FIGS. 3 and 4).

The mask 10 also includes a flexible skirt 24 secured to the frame and constructed and arranged to provide a water-tight seal between the frame and the diver or user's face. The skirt 24 is preferably made of a transparent, flexible material which is resistant to chemical degradation of the type experienced in salt water. A particularly preferred skirt material is silicone. The skirt 24 has a peripheral edge 26 dimensioned to define a line extending around the user's forehead, temples, upper cheeks and under the nose so that once in position, the area of the face located within the line is sealed from the ingress of ambient water.

Each of the first and second side portions 16, 18 will now be described in greater detail. To simplify the following discussion, the two side portions will be considered to be identical unless otherwise specified. In the preferred embodiment, each side portion is provided with one half of a quick-release buckle generally designated 28, the buckle being made up of first and second coupling portions 30, 32, respectively, which may also be characterized as being male and female buckle portions, respectively.

Referring now to FIGS. 1–8, the first coupling portion 30 includes at a first end a prong portion 34 for engaging the second coupling portion 32, and a strap retaining portion 36 opposite the prong portion for retaining an end 38 of a mask strap 40. Included on the prong portion 34 are a pair of resilient latch arms 42 disposed in generally equidistantly spaced relationship on either side of an axially extending guide arm 44. The latch arms 42 have an inherent biasing force such that when squeezed together in the direction of the guide arm 44, and then released, the arms will return toward their original or at rest position depicted in FIGS. 5 and 7. This biasing force facilitates the releasability as well as the locking engagement of the first coupling portion 30 and the second coupling portion 32.

Each latch arm has an end formed into a locking lobe 46 with an inclined tip 48. Opposite the inclined tip, the locking lobe 46 defines a retaining shoulder 49. The tip 48 of each latch arm and an end of the guide arm 44 terminate generally along a common transverse axis.

At the opposite ends, the latch arms 42 and the guide arm 44 are secured to a generally concave edge 50 of the first coupling portion 30. Behind the concave edge 50 and opposite the latch arms 42 and the guide arm 44 is located the strap retaining latch portion 36. A generally transverse pivot post 52 is rotatably supported at each end by a bore 53 in a pivot post support 54. The pair of pivot post supports extend in generally offset parallel relation to the latch arms 42 and the guide arm 44 (best seen in FIG. 5). The pivot post supports 54 are preferably integrally molded to the coupling portion 30.

Figure 8:
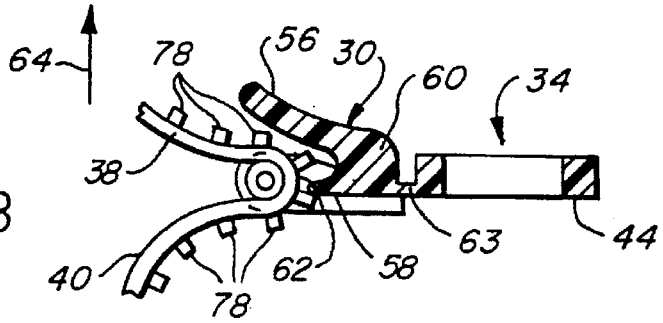
FIG. 8 is a sectional view taken along the line 8—8 of FIG. 7 and in the direction indicated generally.

Also located on the first coupling portion 30 is a grasping handle or tab 56 which is integral with a latch member or keeper tooth 58 (best seen in FIG. 8). The tab 56 has a relatively large surface, is curved for easy grasping, and is joined to the coupling portion along a baseline designated 60 which is generally adjacent the concave edge 50. In addition, the tab 56 may be provided with a plurality of grooves or checking 66 (best seen in FIG. 3) to facilitate a positive grip by the diver even under wet conditions.

The tooth 58 is integral with the coupling portion, is disposed between the pivot post supports 54 and is also in generally parallel relationship to the pivot post 52. A sharp leading edge 62 of the tooth 58 points toward the post 52. Also, the tooth 58 is placed in spaced, parallel relation to the axially rotatable pivot post 52 to permit sliding action of one of the ends 38 of the mask strap 40 therethrough.

Thus, the prong portion, 34, the pivot post supports 54, the grasping tab 56 and the keeper tooth 58 are all preferably unitarily formed, as by injection molding of suitable plastic materials. Due to the inherent "memory" of the plastic material used to mold the first coupling portion 30, and the baseline attachment of the tab 56, the tooth 58 has an inherent biasing force which urges the tooth to the rest position depicted in FIG. 8. The biasing force exerted by the tooth 58 is enhanced by a laterally thinned hinge area 63 (best seen in FIG. 8) on the first coupling portion 30 which defines a pivot axis for the tooth 58 as well as the tab 56. A pulling action of the tab 56 in the direction of the arrow 64 will temporarily draw the tooth 58 away from the pivot post 52, and a release of the tab will cause the tooth to resume its "rest" position.

Figure 2:
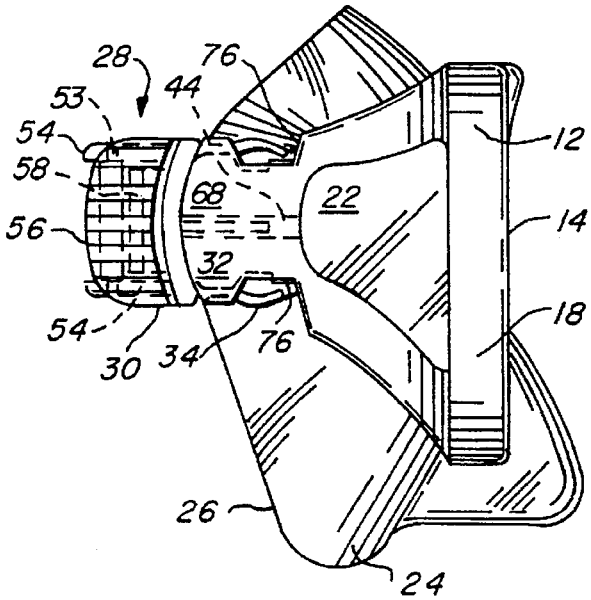
FIG. 2 is a side elevational view of the mask of FIG. 1.
Figure 3:
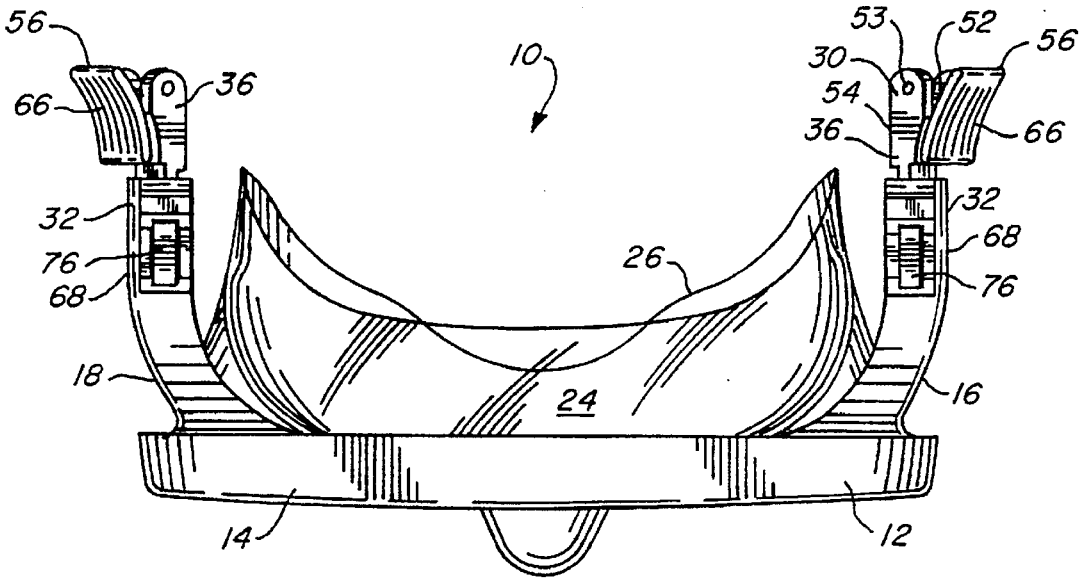
FIG. 3 is a top plan view of the present mask.
Figure 4:
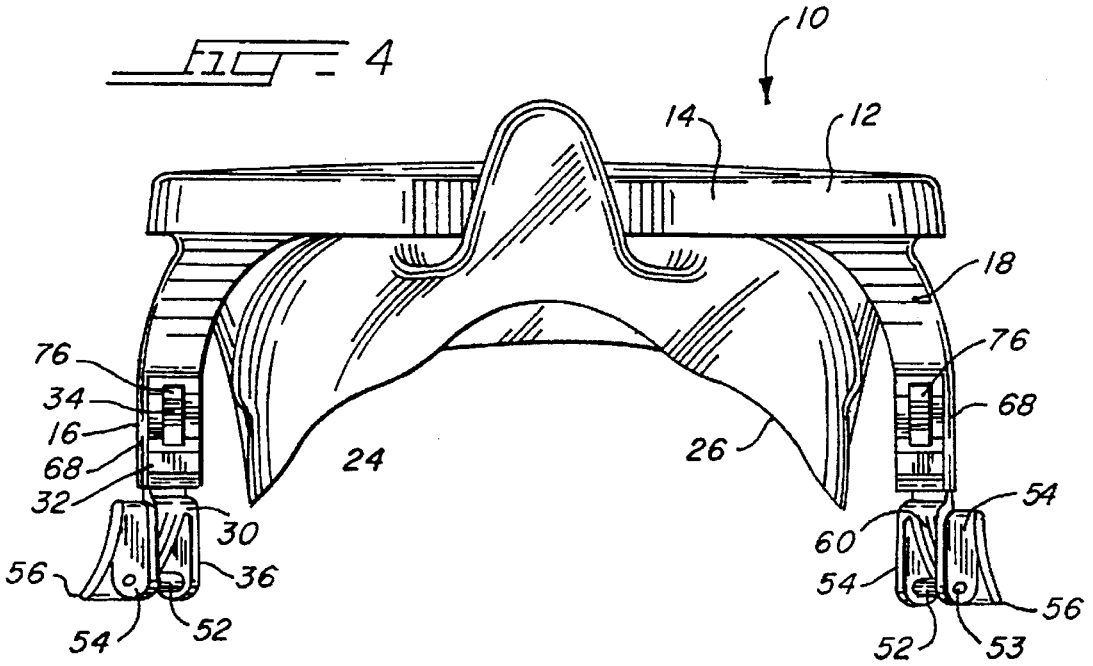
FIG. 4 is a bottom plan view of the mask of FIG. 1.
Figure 5:
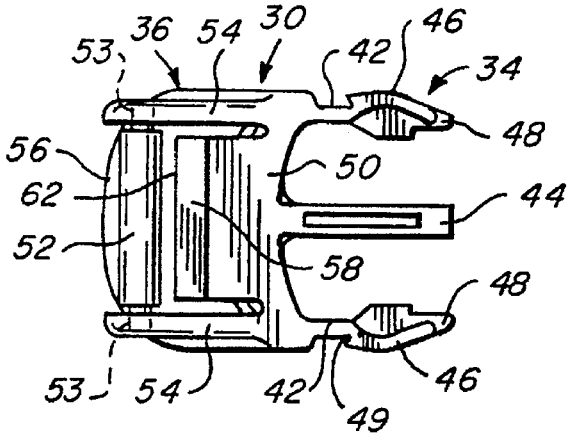
FIG. 5 is a bottom plan elevational view of a first coupling portion of a quick-release buckle of the type suitable for use with the present diving mask.
Figure 6:
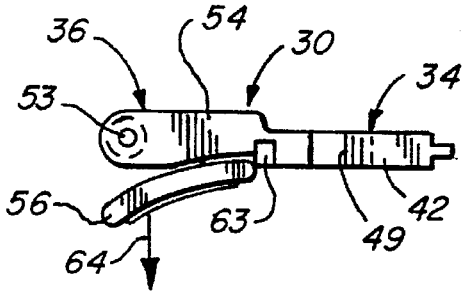
FIG. 6 is a side elevational view of the coupling portion of FIG. 5.
Figure 7:
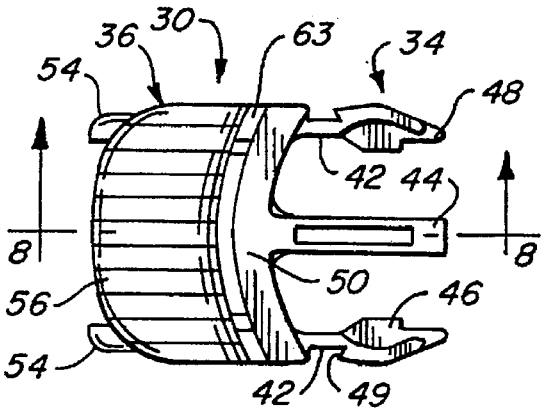
FIG. 7 is a top plan elevational view of the first coupling portion shown in FIG. 5.
Figure 9:
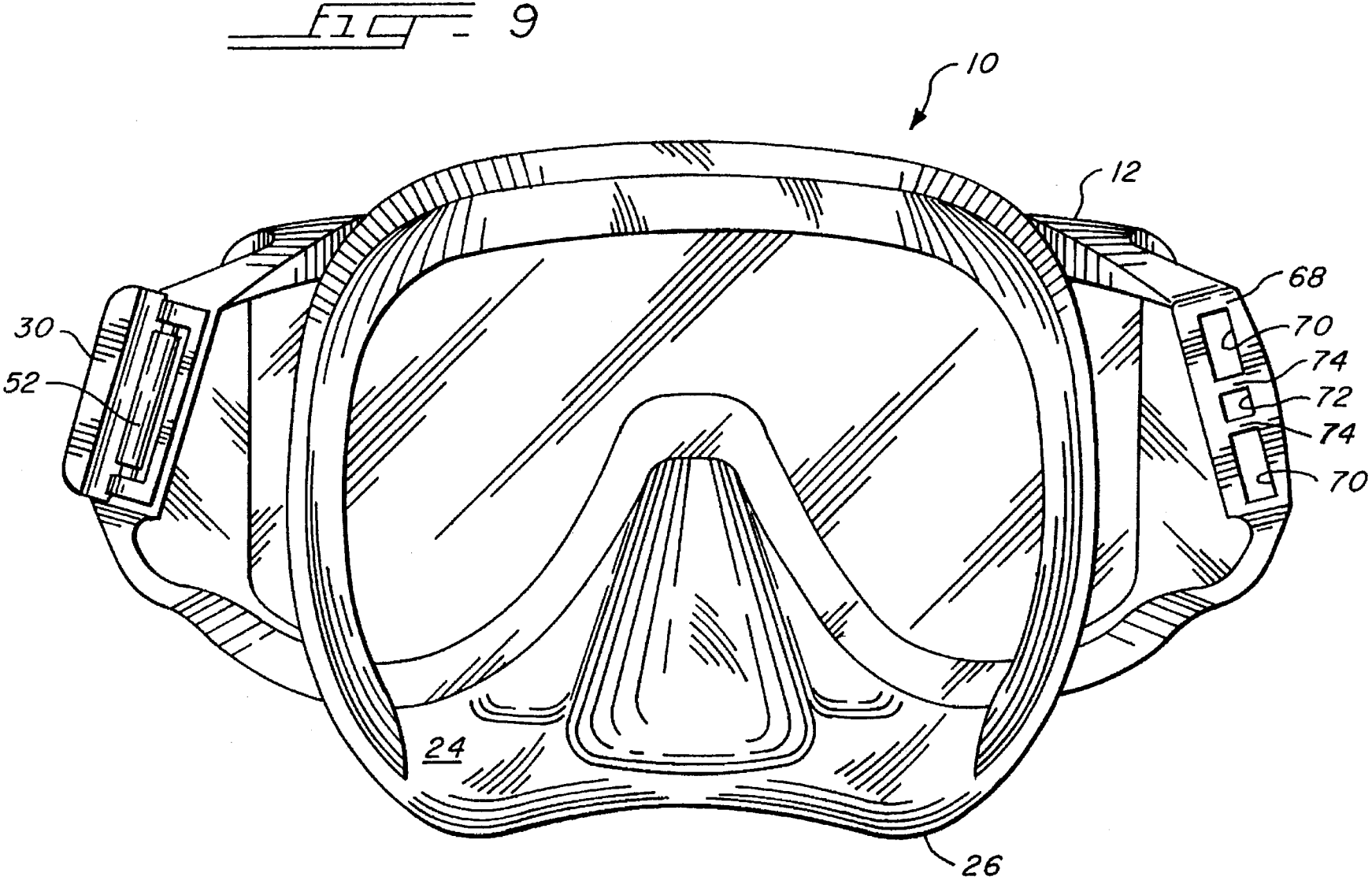
FIG. 9 is a rear elevational view of the mask of FIG. 1, with portions shown eliminated for purposes of clarity.

Turning now to FIGS. 1, 2 and 9, the quick-release buckle 28 also includes the second coupling portion 32, which is configured to lockingly and releasably accommodate the first coupling portion 30 described above. Accordingly, the second coupling portion includes a housing 68 which defines a pair of latch arm receptacles 70 (best seen in FIG. 9) located in laterally spaced relationship to each other, and being separated by a guide arm receptacle 72. The guide arm receptacle is defined by a pair of generally parallel, substantially vertically projecting divider walls 74 which are preferably integrally formed with the housing 68.

An important feature of the second coupling portion 32 is the provision of at least one and preferably two release openings 76 (best seen in FIG. 2) for providing access to a corresponding one of the locking lobes 46, each of which is attached to a corresponding latch arm 42. Each release opening 76 is dimensioned to be accessible by a diver's finger for depressing the locking lobe 46 toward the guide arm 44 and thus, by overcoming the biasing force of the latch arms, releasing the first coupling portion 30 from the second coupling portion 32.

It should be noted that while in the preferred embodiment, the second coupling portion 32 is fixed and integrally formed into the first and second side portions 16, 18 of the mask frame 12, the coupling portion 32, and specifically the housing 68 may be pivotally attached to the corresponding mask frame side portions. It is also contemplated that the relative orientation of the prong portion 34 of the first coupling portion 30, and the second coupling portion 32 may be reversed, with the second coupling portion affixed to the strap retaining portion 36, and the prong portion 34 affixed to the first and second side portions 16, 18 of the frame 12.

Referring now to FIG. 8, the mask strap 40 is provided with a plurality of locking formations 78 for engaging the tooth 58 and securing the length adjustment of the strap to suit the diver. In the preferred embodiment, the locking formations 78 take the form of spaced, generally parallel, elongate projections or ribs. The spacing of the ribs along the strap 40 may vary to suit the application and size of the mask. In addition, the specific shape of the ribs may also vary, as long as the ribs are sufficiently large to engage the tooth 58. Further, it is preferred that both ends 38 of the mask strap 40 are provided with a plurality of the rib-type locking formations 78.

In operation, at least one side portion 16, 18 of the mask frame 12, and preferably both such side portions, are provided with a quick-release buckle 28 including first and second coupling portions 30, 32 engaged to each other. Each end 38 of the mask strap 40 is threaded through a corresponding one of the strap retaining portions 36. Specifically, the strap end 38 is passed between the pivot post 52 and the keeper tooth 58. During the threading operation, the diver must pull the tab 56 in the direction of the arrow 64, which is away from the diver's head, so that the tooth will not engage one of the locking formations 78 on the strap 40. The strap end 38 is then pulled through the strap retaining portion so that the strap end is located on the same side of the pivot post 52 as is the tab 56.

Once a proper length adjustment for each strap end 38 is obtained, and it should be understood that this strap adjustment process may be performed while the mask is worn by the diver, the tab 56 is released, and the tooth 58 engages the next adjacent locking formation 78 on the mask strap 40. The biasing force exerted by the tooth prevents any movement of the strap relative to the buckle 28 other than the distance between the adjacent formations 78 on either side of the tooth 58. Also, the size, shape and checkered surface of the tab 56 facilitate manipulation under wet conditions.

When the diver desires to connect a mask strap retainer of a snorkel, he merely accesses the release openings 76 and squeezes the two locking lobes 46 together until the lobes may be axially withdrawn from the corresponding latch arm receptacles 70. The mask strap 40 may thus be disengaged from the mask frame 12 without affecting the mask strap adjustment. Another instance when the mask strap may need to be rapidly disengaged from the mask frame is when the diver's hair becomes tangled in the strap.

To reattach the mask strap 40 to the mask frame 12, the diver merely inserts the prong portion 34 into the second coupling portion 32 so that the latch arms 42 and the guide arm 44 are aligned with the corresponding receptacles, 70, 72. The first coupling portion is then axially urged toward the second coupling portion housing 68 until the locking lobes snap into the release openings 76. The snapping action of the lobes is due to their inherent biasing force and also to the configuration of the housing 68 which is narrowed somewhat to put an inwardly directed pressure on the locking lobes prior to their reaching the release openings. The retaining shoulders 49 then become engaged in the release openings to prevent unwanted axial decoupling of the first and second coupling portions.

Thus, a major advantage of the present invention is the provision of a diving mask with a quick-release mask strap attachment for permitting rapid disengagement of the mask strap from the frame without changing the length adjustment of the strap. Mother advantage of the present invention is that the first coupling portion may be integrally molded as a unitary piece including the mask strap attachment, the prong portion, and the tab 56 and keeper tooth 58, without requiring detailed assembly or complicated manufacturing tooling. The only additional component is the pivot post 52.

While a particular embodiment of the diving mask with quick-release strap attachment of the invention has been shown and described, it will be appreciated by those skilled in the art that changes and modifications may be made thereto without departing from the invention in its broader aspects and as set forth in the following claims.

What is claimed is:

1. A diving mask, comprising:

a frame including a front portion, rearwardly extending first and second side portions and enclosing at least one lens;

a flexible skirt secured to said frame and constructed and arranged to provide a water-tight seal between said frame and the user's face;

at least one of said side portions having one of a first and second coupling portions of a corresponding quick-release buckle affixed thereto, said coupling portions of each said buckle configured for mating engagement with each other so that the other one of said coupling portions matingly engages said corresponding affixed portion through an axially forward direction of insertion towards said front portion of said frame, said coupling portions being configured to disengage from each other in an axially rearward direction away from said front portion; and a mask strap having first and second ends, at least one of said ends being engaged with the other of said first and second coupling portions so as to extend coaxially from a rear end of said other portion for effecting a releasably lockable coupling of said strap to said frame.

2. The mask as defined in claim 1 wherein the other of said first and second coupling portions which is engaged with said end of said mask strap is provided with a strap length adjustment latch.

3. The mask as defined in claim 2 wherein said adjustment latch is unitary with the other of said first and second coupling portions and includes a biased latch member which is normally biased against said strap, and a grasping portion for exerting a release force to overcome said biasing force to release said strap.

4. The mask as defined in claim 3 wherein said strap is provided with a plurality of spaced locking formations configured for engaging said latch member.

5. The mask as defined in claim 1 wherein said first coupling portion of each said buckle includes a prong portion for engaging said second coupling portion, and a strap retaining portion for retaining said mask strap.

6. The mask as defined in claim 5 wherein said prong portion includes a pair of spaced resilient latch arms disposed on either side of an axially extending guide arm.

7. The mask as defined in claim 6 wherein each of said latch arms includes a locking lobe disposed on a corresponding end of said latch arm.

8. The mask as defined in claim 6 wherein said second coupling portion includes a housing defining at least one receptacle dimensioned to accommodate said latch arms and said guide arm.

9. The mask as defined in claim 8 wherein said receptacle housing further includes at least one release opening for providing access to a corresponding one of said latch arms for overcoming said biasing force and releasing said first coupling portion from said second coupling portion.

10. The mask as defined in claim 1 wherein said one of said first and second coupling portions is integrally formed with said corresponding one of said side portions of said frame.

11. A diving mask, comprising:

a frame including a front portion and rearwardly extending first and second side portions and enclosing at least one lens;

a flexible skirt secured to said frame and constructed and arranged to provide a water-tight seal between said frame and the user's face;

a mask strap having first and second ends, at least one of said ends being engaged with a first coupling portion of a quick-release buckle so as to extend coaxially from a rear end of said first coupling portion for effecting a releasably lockable coupling of said strap to said frame, said first coupling portion having a pair of resilient, biased latch arms disposed on either side of an axially extending guide arm;

at least one of said first and second side portions of said frame having a second coupling portion of said buckle attached thereto, said second coupling portion including a housing defining at least one receptacle configured for accommodating said latch arms and said guide arm, said first coupling portion constructed to engage said second coupling portion through an axially forward direction of insertion towards said front portion of said frame, and also having at least one release opening for permitting access to said latch arms for disengaging said first coupling portion from said second coupling portion in an axially rearward direction away from said front portion;

wherein said mask strap may be adjusted in length independently of the attachment of said strap to said mask frame.

12. The mask as defined in claim 11 wherein said first coupling portion is provided with a strap length adjustment latch.

13. The mask as defined in claim 12 wherein said adjustment latch includes a biased latch tooth which is normally biased against said strap and a grasping portion for exerting a release force to overcome said biasing force to release said strap.

14. The mask as defined in claim 13 wherein said strap is provided with a plurality of spaced locking formations configured for engaging said latch tooth.

15. The mask as defined in claim 11 wherein said second coupling portion is integrally formed with said frame.

16. A diving mask, comprising:

a frame including a front portion, rearwardly extending first and second side portions and enclosing at least one lens;

a flexible skirt secured to said frame and constructed and arranged to provide a water-tight seal between said frame and the user's face;

each of said side portions having an end to which is mounted one of a first and second coupling portions of a corresponding quick-release buckle, said coupling portions of each said buckle configured for mating engagement with each other so that the other one of said coupling portions matingly engages said corresponding affixed portion through an axially forward direction of insertion towards said front portion of said frame, said coupling portions being configured to disengage from each other in an axially rearward direction away from said front portion; and a mask strap having first and second ends, each of said ends being engaged with the other of said first and second coupling portions of said quick-release buckle so as to extend coaxially from a rear end of said other portion for effecting a releasably lockable coupling of said strap to said frame, said coupling portion engaged on said mask strap ends also being provided with a mask strap length adjustment mechanism;

wherein said mask strap may be adjusted in length independently of the attachment of said strap to said mask frame.

17. The mask as defined in claim 16 wherein said mask strap length adjustment mechanism is integral with one of said first and second coupling portions.

* * * * *